United States Patent [19]

Lautenschlager, Jr.

[11] 4,187,580

[45] Feb. 12, 1980

[54] OVER-CENTER HINGE

[75] Inventor: Karl Lautenschläger, Jr., Reinheim, Fed. Rep. of Germany

[73] Assignee: Karl Lautenschlager KG Mobelbeschlagfabrik, Reinheim, Fed. Rep. of Germany

[21] Appl. No.: 15,155

[22] Filed: Feb. 26, 1979

[30] Foreign Application Priority Data

Mar. 22, 1978 [DE] Fed. Rep. of Germany ..... 2812459

[51] Int. Cl.[2] ..... E05D 11/10

[52] U.S. Cl. ..... 16/145; 16/163

[58] Field of Search ..... 16/182, 183, 180, 190, 16/188, 142, 145, 163, 164

[56] References Cited

U.S. PATENT DOCUMENTS

| | | | |
|---|---|---|---|
| 2,623,236 | 12/1952 | Borchers et al. | 16/182 X |
| 4,091,500 | 5/1978 | Lautenschlager | 16/145 |

*Primary Examiner*—Andrew V. Kundrat

[57] ABSTRACT

Hinge for furniture doors, having a door-related hinge part in the form of a cup-like element for mounting in a recess in the door, in whose circumferential wall a sloping, separately manufactured knuckle subject to the effect of a compression spring is mounted for pivoting by a given angular mount and during at least a portion of the opening or closing movement slides on a bearing surface provided on the other hinge part at its extremity facing the joint and is movable past a dead-center position on this side of which it urges the door to the closed position and beyond which it exerts a pressure in the direction of opening, the bearing surface being situated adjacent the fulcrum of the knuckle when the latter is in the closed position. The knuckle terminates at its bottom end pivotally mounted in the cup-like element in a transversely disposed, relatively narrow edge and is inserted in an upwardly facing deepened fulcrum pocket. The upper end of the knuckle opposite the bearing end is defined approximately by an arc of a circle whose center coincides approximately with the fulcrum of the knuckle, while the knuckle is secured against escape from the fulcrum pocket by a wall portion of the cup-like element which closely overarches its upper end in every position within its given range of movement.

3 Claims, 2 Drawing Figures

OVER-CENTER HINGE

BACKGROUND

Figure 1:
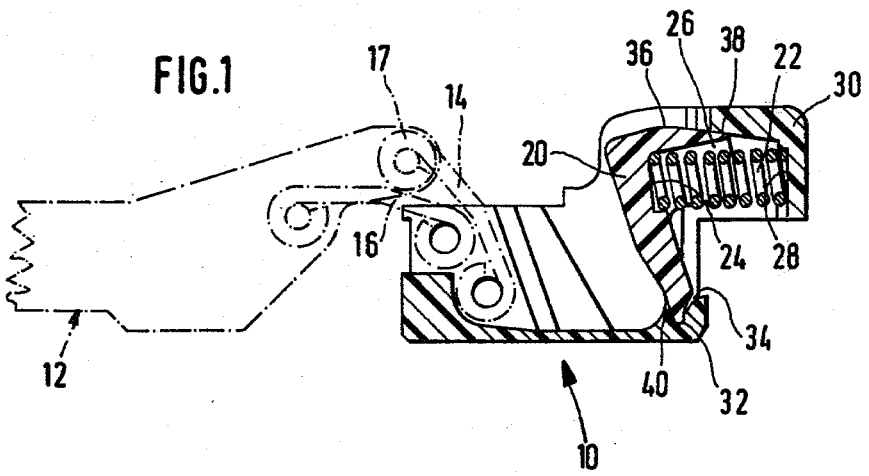

The invention relates to an over-center hinge for furniture doors, which has a door-related part in the form of a cup-like element designed to be forced into a recess in the door, in whose peripheral wall a knuckle made separately and biased by a compression spring is mounted for pivoting within a given angle and slides, at least during a portion of the opening and closing movement, against a contact surface provided on the end of the other hinge part, and can be moved through a dead center position on one side of which it urges the door to the closed position and beyond which it exerts a pressure in the opening direction, the contact surface being situated adjacent the pivot axis of the knuckle when the knuckle is in the closed position.

Such hinges, whose over-center mechanism is formed by a resilient knuckle mounted in an opening in the circumferential wall of the cup-shaped element, are known. In such cases, in which the cup-shaped element and the knuckle are made of plastic, the knuckle was originally made integral with the cup-shaped element at its lower pivot point (DB Pat. No. 2,016,398). In further development of this known over-center hinge, the knuckle was then later made as a separate piece and held in the cup-shaped element by means of a pin passed through bores provided in the bottom end of the knuckle and in the cup-like element (DB Pat. No. 2,122,857). These known hinges have proven successful and are used in great numbers.

However, when the knuckle is being installed in the cup-like element of these known hinges, it can happen, though rarely, that the bore in the knuckle is not precisely aligned with the bores in the cup-like element when the pivot pin is being pressed into place. When the pin is being pressed in, it can then happen that the pin may deflect the knuckle sideways or even destroy its bottom pivot end. Such hinges in which the end has been destroyed or has not been penetrated by the pin have to be discarded, and therefore careful inspection of the assembled cup-like elements is necessary.

THE INVENTION

The invention has the object of improving the over-center mechanism of the known hinge such that the expensive pressing in place of the pin for the pivotal mounting of the knuckle in the cup-like element can be eliminated and with it the dangers described above of the faulty installation of the knuckle.

Setting out from a hinge of the kind described above, this object is achieved by the invention in that the knuckle terminates at its bottom end, which is to be pivotally mounted in the cup-like element, in a relatively narrow, transversely disposed edge and is inserted in an upwardly facing fulcrum pocket in the cup-like element; that the upper end of the knuckle opposite the pivoted end has an external profile substantially in the shape of an arc of a circle centered approximately on the pivot axis of the knuckle, and that the knuckle is secured against escape from the fulcrum pocket by a section of the wall of the cup-like element, which closely overarches it. The pivoting system of the known hinges involving the use of a pivot pin is therefore replaced by a pivoting system that is comparable to a knife-edge bearing. Due to the elimination of the need for a fulcrum hole at the bottom end of the knuckle, the knuckle can also be made slightly shorter for the same effective lever length, and accordingly the section of the wall of the cup-like element which accommodates the knuckle becomes shorter. The recess which extends all the way through the bottom of the cup-like element in the known hinges therefore now terminates above this bottom, so that the bottom portion of the cup-like element now becomes more rigid overall and can withstand greater radial stress. Especially when the cup-like element is of the kind that is hammered or pressed into place and held without additional fastening means merely by making its diameter oversize for the mounting recess or mortise, greater radial holding strength can be achieved, and with it a more secure seating of the cup-like element in the door leaf.

The bottom edge of the knuckle, however, in contrast to the sharp-edged configuration involved in knife-edge bearings, is preferably rounded, and the corresponding fulcrum pocket is rounded accordingly. Thus, the knuckle is seated on a sufficiently large surface area in the fulcrum pocket to forestall premature wear.

In an advantageous further development of the invention, the design can be made such that the knuckle and/or the cup-like element are made resiliently deformable in the area of the fulcrum pocket such that the knuckle can be snapped with resilient deformation into the pocket.

Figure 2:
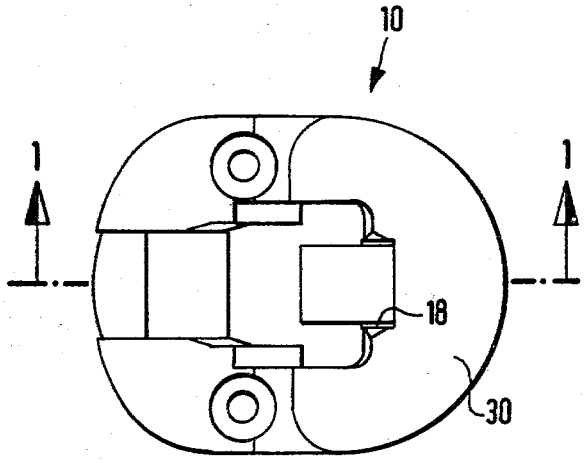

The invention will be further explained in the description that follows of its embodiment, in conjunction with the drawing wherein:

FIG. 1 is a cross sectional view taken through the door-related part of an over-center hinge of the invention, which is in the form of a cup-like element to be force-fitted into a recess, as seen in the direction of the arrows 1—1 of FIG. 2, and FIG. 2 is a top plan view of the cup-like element of the hinge shown in FIG. 1.

In the drawings, the door-related part of an over-center hinge intended for mounting a glass door on the wall of a cabinet is in the form of a cup designed to be pressed into a recess in the door, a portion of the wall-related part of the hinge, which is in the form of an elongated supporting arm 12, and the hinge links 14 and 16 articulated to the supporting arm 12 at one end and to the cup-like element 10 on the other being also indicated in broken lines. In FIG. 1 it can be seen that, when the cup-like element 10 is swung from the open position in which it is represented, to the closed position, the eye 17 at the supporting-arm end of the hinge link 14 will run against the knuckle 20 which is disposed in an opening 18 in the wall of the cup-like element and can pivot at its lower end in the cup-like element, and which is urged by a compressively biased spring 22 into the position shown in which it protrudes into the interior of the cup and in which it is pressed by lateral abutments (not shown) against corresponding counter-abutments on the cup-like element.

As soon as the eye of the link has come into engagement with the knuckle, it slides downwardly over the face of the knuckle and, as the closing movement continues, deflects the knuckle clockwise against the action of the spring until a dead center position is reached beyond which the knuckle 20 is rocked back again counterclockwise by the spring, thereby exerting on the eye 17 a force acting in the closing direction. In the closed position the eye will then be directly adjacent the lower, pivoted end of the knuckle, although the knuckle will not have returned all the way to the left end position, so that it then exerts a permanent closing pressure on the eye. A door equipped with the hinge of the invention is therefore resiliently held in the closed position.

The spring 22 is supported at one end at the bottom 24 of a recess 26 provided in the knuckle 20, and at the other end against the back wall 28 of a hollow appendix 30 of the cup-like element 10, which is closed at the top but open at the bottom for the installation of the spring.

The knuckle 20 terminates at its lower end in a rounded, transversely disposed edge 32 which is engaged in an upwardly facing pocket 34 whose bottom is rounded to match the roundness of the edge 32, the knuckle 20 being thus fulcrumed in the pocket 34.

The escape of the edge 32 of knuckle 20 from fulcrum pocket 34 is prevented by the fact that the upper profile of the knuckle at 36 is defined by an arc of a circle whose center coincides approximately with the fulcrum of the knuckle. This arcuate surface 36 is closely contained in all possible positions of the knuckle beneath an upper horizontal section 38 of the appendix 30, so that it is impossible for the knuckle 20 to be displaced upwardly to such an extent that its bottom edge 32 might escape from the fulcrum pocket 34.

The knuckle 20 can be installed in the cup-like element 10 by introducing its bottom end 32 from without through the opening 18 in the cup-like element in an approximately horizontal position and then raising it to the upright position in which its upper ends comes to rest in the hollow interior of the appendix 30, while the bottom, rounded edge slides along the bottom of the cup-like element 10 until it reaches a position in which the edge 32 is in front of the low, rib-like wall section 40 defining the inner edge of the fulcrum pocket 34. Pressure applied to the bottom end of the knuckle will snap the edge 32 with resilient deformation of the knuckle and/or of the bottom of the cup-like element, over the wall section 40 and into the bearing pocket 34. The spring 28 can then be installed through the open underside of the appendix 30.

Alternatively, the knuckle 20 can also be installed by inserting its bottom end 32 from the inside of the cup-like element 10 into fulcrum pocket 34 and then pushing the upper end of the knuckle through the opening 18 in the wall of the cup-like element 10. The opening 18 will be resiliently expanded by the above-mentioned (not illustrated) lateral abutments on the knuckle, but after the lateral abutments have been passed it will return to its original width, and then the counter-abutments provided on the cup-like element adjacent the abutments on the knuckle will prevent the knuckle from being rotated back into the interior of the cup-like element. The spring 28 is then installed through the open underside of the appendix 30.

In the embodiment represented in the drawing, both the cup-like element 10 and the knuckle 20 are made of plastic, so that both parts are to a certain extent resiliently deformable, and it is therefore possible to snap the knuckle in place without difficulty. If the cup-like element is made of a less resilient metal, such as die casting metal, the knuckle must be made more resilient accordingly, or the bottom of the cup-like element must be made resiliently deformable by appropriate design. This can be accomplished, for example, by separating the area containing the bearing socket 34 from the side walls by lateral slits, so that it will form a resilient tongue.

It is to be noted in any case that the system of pivotally mounting the knuckle 20 in the cup-like element is not restricted to hinges which the cup-like element and/or the knuckles are made of plastic. It is furthermore to be observed that the bearing arrangement in accordance with the invention is also suitable for hinges in which the cup-like element 10 is not, as in the present case, designed as a part of a hinge for glass doors, but for ordinary wood doors.

I claim:

1. A hinge for a furniture door, having a door-related hinge part in the form of a cup-like element for mounting in a recess in a door, said element having a bottom portion with a pocket, and a wall portion spaced from said bottom portion, a knuckle mounted in said element for pivoting by a given angular amount, a compression spring acting on said knuckle, a bearing surface provided on said element, said knuckle being movable through a dead-center position on one side of which it urges the door to a closed position and on the other side of which it exerts a pressure in the direction of opening said door, said knuckle having one end in the form of a relatively narrow edge, said edge being inserted in said pocket so as to form a fulcrum, the other end of said knuckle being remote from said one end and defining approximately an arc of a circle whose center coincides approximately with the fulcrum of the knuckle, said knuckle being secured against escape from the fulcrum pocket by said wall portion of said cup-like element, said wall portion closely overarching said other end in every position of movement of said knuckle.

2. A hinge according to claim 1, wherein said edge of the knuckle is defined approximately by an arc of a circle in cross section and the fulcrum pocket is complementarily arcuately rounded.

3. A hinge according to claim 1 or 2, wherein at least one of said knuckle and cup-like element in the area of the fulcrum pocket is made to be resiliently deformable such that the knuckle will be able to snap with resilient deformation into the fulcrum pocket.

* * * * *